US008898939B2

(12) United States Patent
Kibbe et al.

(10) Patent No.: US 8,898,939 B2
(45) Date of Patent: Dec. 2, 2014

(54) GIFT CARD HOLDER

(75) Inventors: Sara F. Kibbe, Topeka, KS (US); Timothy G. Bodendistel, Lenexa, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 13/448,935

(22) Filed: Apr. 17, 2012

(65) Prior Publication Data

US 2012/0260542 A1 Oct. 18, 2012

Related U.S. Application Data

(62) Division of application No. 11/249,289, filed on Oct. 13, 2005, now abandoned.

(51) Int. Cl.

| | |
|---|---|
| ***G09F 1/06*** | (2006.01) |
| ***B65D 27/00*** | (2006.01) |
| ***B42D 15/04*** | (2006.01) |
| *B42F 7/06* | (2006.01) |
| *G09F 1/00* | (2006.01) |

(52) U.S. Cl.

CPC ... *G09F 1/06* (2013.01); *B42F 7/06* (2013.01); *G09F 1/00* (2013.01); *B42D 15/045* (2013.01)

USPC ..... 40/124.06; 40/124.191; 229/92.8; 229/70; 229/71; 229/67.1; 206/232; 206/300; 206/101; 206/106; 283/117; 281/29

(58) Field of Classification Search

CPC ..... G09F 1/00; G09F 1/06; B42F 7/06; B42F 7/02; B42F 7/08

USPC ..... 40/124.06, 124.191; 229/92.8, 70, 71, 229/67.1; 206/769, 232, 300; 283/117; 281/29

See application file for complete search history.

(56) References Cited

U.S. PATENT DOCUMENTS

| | | | | |
|---|---|---|---|---|
| 4,636,179 | A * | 1/1987 | Gentile et al. | 402/79 |
| 4,870,764 | A | 10/1989 | Boone | |
| 5,403,236 | A | 4/1995 | Greig | |
| 5,667,247 | A | 9/1997 | Ramsburg et al. | |
| 5,760,381 | A | 6/1998 | Stich et al. | |
| 5,791,474 | A | 8/1998 | Hansen | |
| 5,836,507 | A * | 11/1998 | Mueller et al. | 229/67.1 |

(Continued)

OTHER PUBLICATIONS

Target Gift Card Holder—2004—p. 1.

(Continued)

*Primary Examiner* — Syed A Islam

(74) *Attorney, Agent, or Firm* — Shook, Hardy & Bacon L.L.P.

(57) ABSTRACT

A combination gift card holder and message delivery package facilitates the identification of a gift card contained within the package while presenting the recipient with an accompanying message prior to fully revealing the gift card. The package includes first, second and third panels. The first and second panels and the second and third panels are connected with one another along a common edge and are pivotable with respect to each other. The panels have cutouts therein. The gift card is positioned in the package between the second and third panels thereby exposing a portion of a front surface of the gift card through the cutout in the third panel and exposing a portion of a rear surface of the gift card through the cutout in the second panel, thereby partially concealing the gift card while exposing an identification marking thereon.

5 Claims, 4 Drawing Sheets

(56) References Cited

U.S. PATENT DOCUMENTS

| | | | | |
|---|---|---|---|---|
| 5,988,685 | A | 11/1999 | Mogelonsky et al. | |
| 6,315,206 | B1 | 11/2001 | Hansen | |
| 6,732,459 | B1 * | 5/2004 | Clark | 40/124.06 |
| 7,024,807 | B2 | 4/2006 | Street | |
| 7,490,720 | B2 * | 2/2009 | Cole et al. | 206/232 |
| 2002/0100797 | A1 | 8/2002 | Hollingsworth et al. | |

OTHER PUBLICATIONS

Fastcard Gift Card Holder—2004—p. 2.
Best Buy Gift Card Holder—2002—p. 3.
Technical Drawing by Hallmark Loyalty Marketing Group, dated Aug. 20, 2001.
Photos of Sample Gift Card, made according to technical drawing, dated Aug. 20, 2001.
U.S. Appl. No. 11/249,289, Non-Final Office Action, dated Aug. 8, 2007.
U.S. Appl. No. 11/249,289, Non-Final Office Action, dated May 30, 2008.
U.S. Appl. No. 11/249,289, Non-Final Office Aciton, dated Dec. 12, 2008.
U.S. Appl. No. 11/249,289, Non-Final Office Action, dated Feb. 18, 2010.
U.S. Appl. No. 11/249,289, Non-Final Office Action dated Aug. 23, 2011.
Canadian Application No. 2528289, Office Action dated Sep. 26, 2007.

* cited by examiner

GIFT CARD HOLDER

CROSS-REFERENCE TO RELATED APPLICATIONS

The present application is a divisional of pending U.S. application Ser. No. 12/249,289, entitled "GIFT CARD HOLDER", filed Oct. 13, 2005.

STATEMENT REGARDING FEDERALLY SPONSORED RESEARCH OR DEVELOPMENT

Not applicable.

BACKGROUND OF THE INVENTION

The present invention relates to gift card holders. More specifically, the present invention is directed to a combination gift card holder and message delivery package that positions associated gift cards for identification while being supported by the package.

Gift cards have become a popular way to present someone with an amount of credit that may be used to purchase goods or services at specified retailers. Some types of gift cards include a magnetic strip that has magnetic encoding for storage of information about the particular card. The magnetic strip controls activation of an account associated with the card, and typically must be swiped through a card reader connected with a central computer that authorizes subsequent purchases with the gift card. Alternatively, a bar code or other types of scanable identification markings may be present on the gift card. The identification markings allow for electronic scanning of the card to register the purchasing of the card and automatically display a retail price for the card. In either case, the magnetic strip or other identification markings enable the gift card to be associated with a particular credit account holding a credit value that can be applied to a retail purchase.

When gift cards are presented, the giver may wish to provide some sort of sentiment or message to go along with the card. For instance, the gift card may be given in association with a recognized holiday or other special occasion for the receiver (e.g., a birthday). Gift giving in this fashion, however, can be burdensome because a separate sentiment item, such as a greeting card, must often be purchased along with the gift card, and then the gift card placed inside of an envelope holding the greeting card in order to secure the items together. Furthermore, once the recipient opens the greeting card, they may focus on the gift card without considering the message of the greeting card that the gift giver intended them to read. It would be beneficial to provide a gift card and sentiment delivery device integrated together as one packaged unit. This would increase the likelihood of the recipient focusing on the sentiment or message along with the gift card.

SUMMARY OF THE INVENTION

A combination gift card holder and message delivery package facilitates the purchase of an associated gift card by exposing a portion of the card for identification so that removal of the card from the packaging at the point-of-purchase is unnecessary. In one aspect, the present invention provides a gift card holding package including first, second and third panels. The first and second panels are connected with one another along a common edge such that the second panel is pivotable with respect to the first panel and juxtaposes the first panel. The third panel extends from the second panel and is oriented to at least partially overlap the second panel. In this way, the package supports and positions the gift card between the second and third panel such that the third panel at least partially conceals the gift card while exposing an identification marking on the gift card through a cutout of the second panel. The identification marking may be a bar code, magnetic strip, or other type of marking that assists the retailer in the purchase transaction while eliminating the need to remove the card from the package to complete the transaction. The third panel may also be formed as a flap pivotable with respect to the second panel, and may have a cutout located to expose indicia on a side of the card opposite of the identification marking while such identification marking is exposed through the cutout of the second panel. This provides the gift recipient with some information about the gift card before the card is fully accessed.

In another aspect, the gift card holding package is provided with a first panel having a cutout sufficiently sized to expose indicia on a first side of a gift card, and a second panel having a cutout sufficiently sized to expose an identification marking on a second side of a gift card. The first and second panels are connected with one another along a common edge such that the second panel is pivotable with respect to the first panel and is juxtaposed the first panel. The package is adapted to support and position the gift card between the first and second panels such that the indicia on the first side of the gift card is exposed through the cutout of the first panel and the identification marking on the second side of the gift card is exposed through the cutout of the second panel while the second panel functions to at least partially conceal the gift card. A third panel may be connected with the second panel along a common edge for pivoting with respect to the second panel. This facilitates the third panel pivoting to overlie the first panel folded over the second panel to conceal the cutout of the first panel. The gift card holding package recipient would therefore be presented with a package where the optional third panel is first viewed, then the third panel folded back to reveal the first panel and the gift card indicia through the associated cutout, and finally the first panel folded back to reveal the second panel and the full gift card.

An integrated gift assembly of the present invention includes a gift card holder and a gift card. The gift card holder includes first, second and third panels, with at least the second panel having a cutout. The first and second panels are pivotably connected with and juxtaposing one another, and the third panel extends from the second panel with an orientation to at least partially overlap the second panel. The gift card has a first side with an identification marking and a second side. The gift card holder is adapted to removably secure the gift card between the second and third panels to at least partially conceal the gift card while exposing the identification marking on the gift card through the cutout of the second panel.

In another aspect, the integrated gift assembly includes a gift card holder having first and second panels, and a gift card. The first and second panels are pivotably connected with and juxtaposed one another, and each panel has a cutout. The gift card has a first side with an identification marking and a second side with indicia. The gift card holder is adapted to removably secure the gift card between the first and second panels such that the indicia on the first side of the gift card is exposed through the cutout of the first panel and the identification marking on the second side of the gift card is exposed through the cutout of the second panel while the second panel at least partially conceals the gift card.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 3:
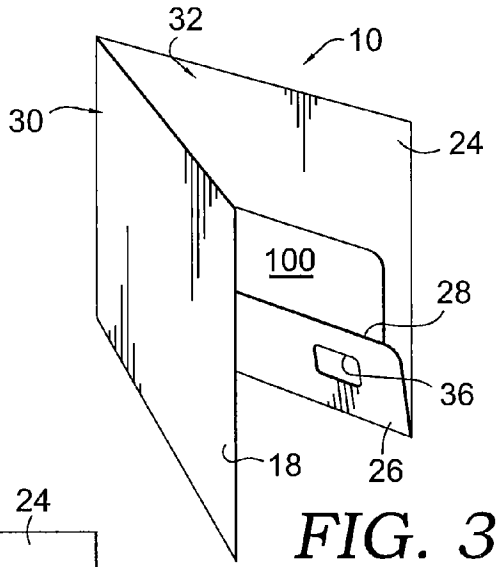
FIG. 3 is a perspective view of the gift card holding package of FIG. 1 supporting a gift card.
Figure 2:
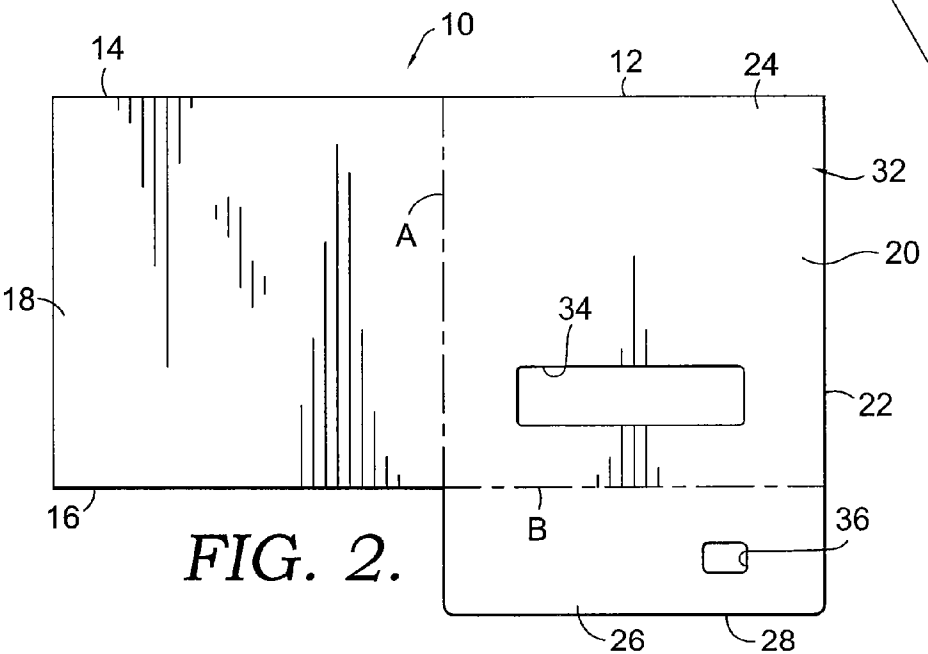
FIG. 2 is a front view of the gift card holding package of FIG. 1 in the fully opened position.
Figure 1:
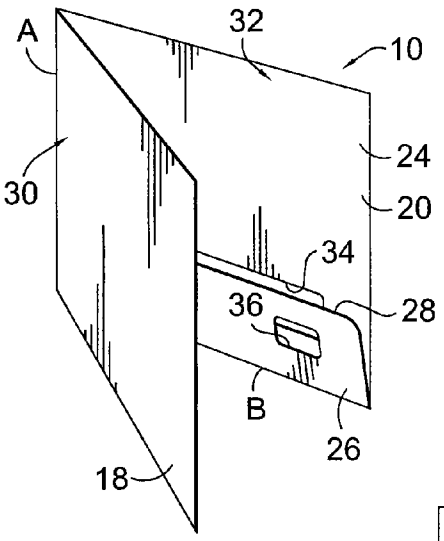
FIG. 1 is a perspective view of one embodiment of a gift card holding package of the present invention.
Figure 4:
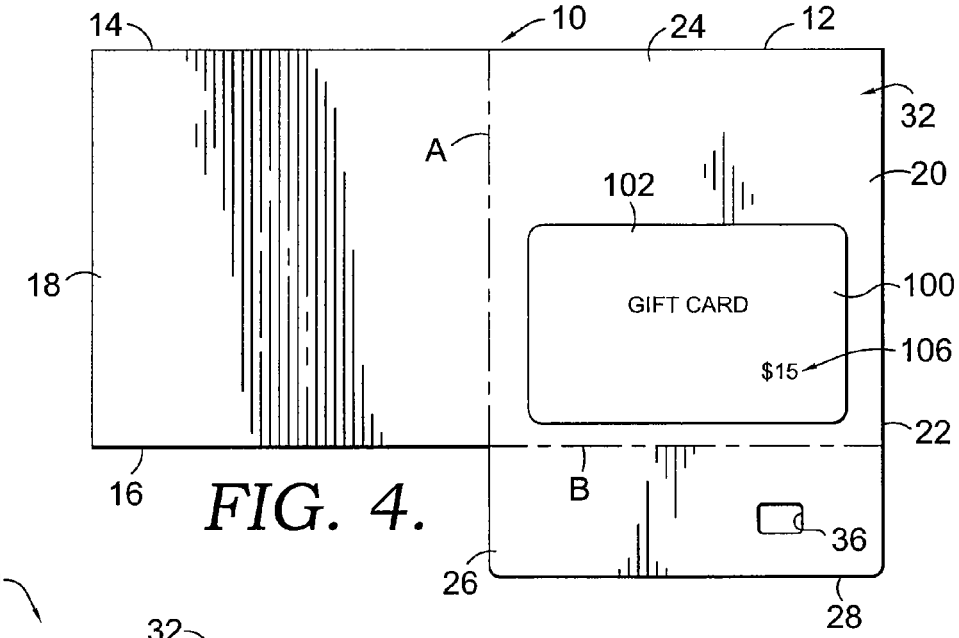
FIG. 4 is a front view of the gift card holding package of FIG. 2 with the gift card secured to a second panel.

With initial reference to FIGS. 1 and 2, an embodiment of a gift card holding package is depicted generally and associated with reference numeral 10. The package 10 may be fabricated from a piece of flat cardstock that is cut along a chosen outline to define an outer boundary 12 of the unfolded package 10. A first line of weakness or fold line A is formed by bending or folding portions of the package 10 with respect to one another along an indicated line extending from a top edge 14 to a primary bottom edge 16 of the package 10. The formation of fold line A, creates a front panel 18 and a back panel 20 for the package 10 on opposed sides of fold line A, with the panels 18 and 20 being pivotable with respect to one another.

Another line of weakness or fold line B is formed by bending portions of the back panel 20 with respect to one another along an indicated line extending from the intersection of fold line A and the primary bottom edge 16 of the package 10 laterally to a rearmost edge 22. Fold line B is therefore perpendicular to fold line A, generally collinear with the primary bottom edge 16, and forms the back panel 20 into a primary back panel member 24, mirroring the outline of the front panel 18, and covering flap 26. The covering flap 26 has a height dimension defined as the distance between fold line B and a secondary bottom edge 28 of the package 10 in the unfolded position shown in FIG. 2.

Upon folding the covering flap 26 upwardly to the position illustrated in FIG. 1, the secondary bottom edge 28 of the package 10 becomes a top edge of the covering flap 26. Thus, the covering flap is sized and dimensioned to partially or fully conceal items placed on the primary back panel member 24. The covering flap 26 is folded upward over a lower portion of the primary back panel member 24 and the front and back panels 18, 20 are folded together to arrange the package 10 in the closed position to conceal items within the package 10. This folding also designates an outer surface 30 and an inner surface 32 for the package 10. In an embodiment where the package 10 is formed as a greeting card, the recipient of the package 10 and enclosed gift item (e.g., a gift card) will first be presented with any message or sentiment on the package outer surface 30 prior to unfolding the package 10 to reveal the gift item secured on the inner surface 32.

The primary back panel member 24 of the package 10 has a cutout 34 sized to expose an identification marking on an item placed between the primary back panel member 24 and the covering flap 26. Similarly, the covering flap 26 has a cutout 36 sized to expose certain indicia on a side of the item opposite of the identification marking. As one exemplary fabrication method, each of the patterned cutouts 34 and 36 may be die cut into the cardstock forming the package 10.

Turning to FIGS. 3-6, the embodiment of the package 10 shown may be used to hold a gift card 100 having an associated amount of purchasing credit. The gift card 100 presents opposed front and back sides 102, 104, with indicia 106 disposed on the front side 102 and a bar code 108 formed on the back side 104 to serve as identification marking. The indicia 106 can include information such as a numerical value of credit associated with the gift card 100 and/or a particular merchant associated with the gift card 100. The bar code 108 may be scanned at the point-of-purchase of the combined package 10 and gift card 100 so that a purchase can be completed without having to remove the gift card 100 from the package 10.

Figure 5:
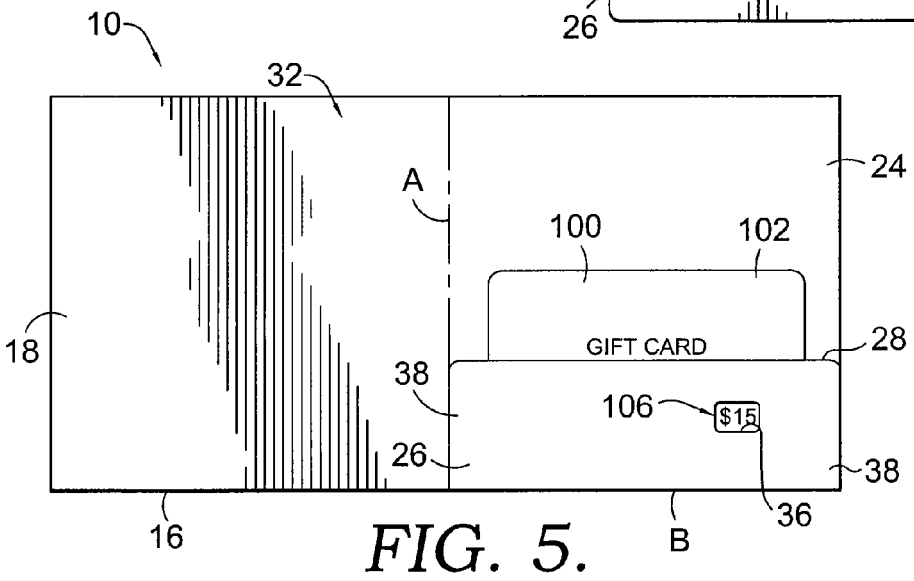
FIG. 5 is a front view of the gift card holding package of FIG. 1 in the partially opened position and with the gift card supported between the second panel and a third panel to expose indicia on a front surface of the gift card through a cutout in the third panel.
Figure 6:
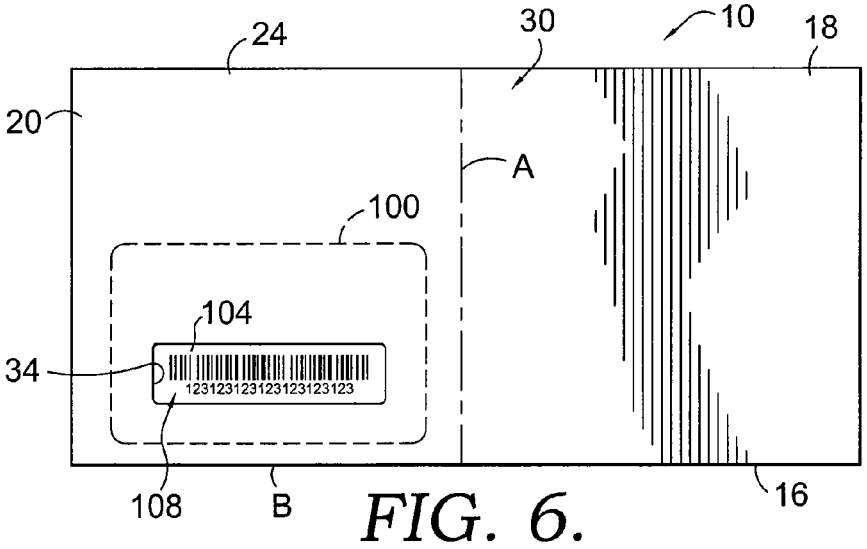
FIG. 6 is a rear view of the gift card holding package of FIG. 5 exposing an identification marking on a rear surface of the gift card through a cutout in the second panel.

More specifically, the back side 104 of the gift card 100 may be removably affixed to the primary back panel member 24 on the package inner surface 32 at a position to expose the bar code 108 through the cutout 34, as depicted in FIG. 6. For instance, the gift card 100 may be attached to the primary back panel member 24 by adhesives or other elements that allow for selective detachment of the card 100 from the package 10 when opened. As seen in the partially opened position of the package 10 in FIG. 5, the cutout 36 is formed on the covering flap 26 at a specific location relative to the cutout 34 of the primary back panel member 24. This positioning of the covering flap cutout 36 exposes the indicia 106 on the front side 102 of the gift card 100 when the card 100 is positioned to expose the bar code 108 on the back side 104 thereof through the cutout 34 in the primary back panel section.

Although each of the cutouts 34, 36 is shown to be generally rectangular, the cutouts 34, 36 may take on other shapes in order to expose the indicia 106 and identification markings 108 while at the same time permitting the concealing of at least some regions of the front and back sides 102, 104 of the gift card 100 that have graphics or wording present. It may be desirable to conceal certain parts of the gift card 100 when the package 10 is first presented to the gift recipient in the closed position. This encourages the gift recipient to read any message or sentiment presented on the package outer surface 30, as well as any additional message presented on the package inner surface 32 after unfolding the front panel 18 of the package 10 and prior to unfolding the covering flap 26 downwardly to fully reveal the entire front side 102 of the gift card 100. For instance, as can be seen in FIG. 5, the gift recipient can open the front panel 18 of the package 10 and see that a gift card of a certain value is present, but the covering flap 26 directs the recipient's focus onto other parts of the package inner surface 32 where an accompanying message may be provided.

In an alternative arrangement, the package 10 may be made of other materials besides cardstock, and may take the form of another package structure, such as a plastic case (e.g., CD jewel case). Thus, the front panel 18 and the primary back panel member 24 would be pivotably connected with one another in the same fashion as the front and back portions of a plastic case. The covering flap 26 could extend from a paper insert mounted to the back portion of the plastic case to partially or fully conceal items accessed by opening the case. It should also be understood that the covering flap 26 may be fixedly positioned on the primary back panel member 24 as a pocket for holding the gift card 100. Thus, opposed side regions 38 of the covering flap 26 may be attached with the primary back panel member 24 so that the flap 26 does not unfold downwardly to the position shown in FIG. 4.

Another embodiment of a gift card holding package 50 is depicted in FIGS. 7-10. This embodiment of the package 50 may be formed by generally the same process as the embodiment of the package 10 depicted in FIGS. 1-6. More specifically, the package 50 may be fabricated from flat cardstock and provided with a fold line C defining a front panel 52 and a back panel 54 on opposite sides of the fold line C, and optionally a fold line D defining a cover panel 56 on a side of the back panel 54 opposite of the front panel 52. Fold lines C and D are generally parallel and spaced from one another, each extending from a top edge 58 to a bottom edge 60 of the package 50.

Figure 7:
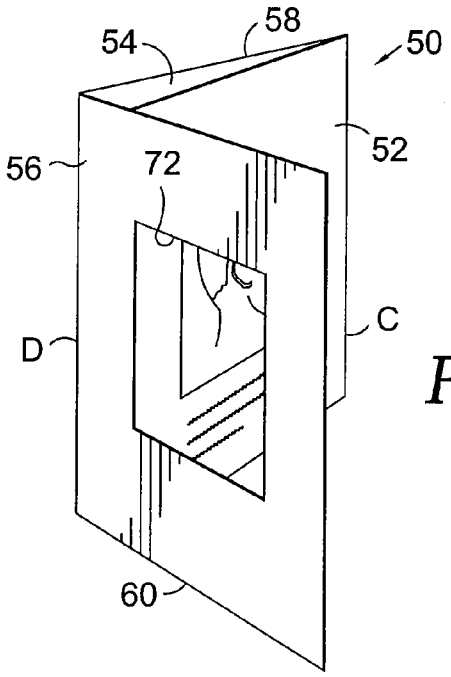
FIG. 7 is a perspective view of a second embodiment of a gift card holding package.

The package 50 is preferably arranged such that the front panel 52 is pivoted or folded over the back panel 54 along fold line C, and then, if provided, the cover panel 56 is pivoted or folded over the front panel 52 along fold line D to form the closed package 50, the folding process being depicted in FIG. 7. The folding pattern designates an inner surface 62 for the package 50, shown in FIG. 8, and an outer surface 64 for the package 50, shown in FIG. 10.

The front panel 52 is shown to have essentially the same dimensions as the back panel 54 so that the folding of the front panel 52 over the back panel 54 will fully conceal the package inner surface 62 of the back panel 54. However, the front panel 52 may, for instance, be dimensioned similarly to the covering flap 26 of the embodiment of the package 10 depicted in FIGS. 1-6, so that the gift card 100 or other gift item removably secured to the back panel 54 is only partially concealed by the front panel 52. The package 50 may take the form of a greeting card to present the recipient with a message or sentiment as the package 50 is unfolded to reveal the gift card 100.

Figure 10:
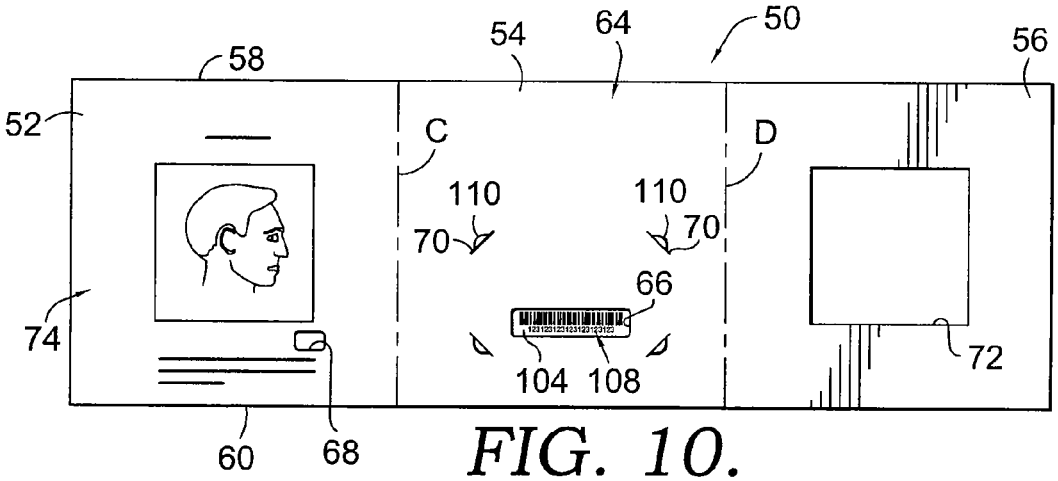
FIG. 10 is a rear view of the gift card holding package of FIG. 8 in the fully opened position and with the gift card secured to the second panel to expose an identification marking on the gift card through a cutout in the second panel.

The back panel 54 has a cutout 66 sized to expose the bar code 108 or other identification marking on the back side 104 of the gift card, while the front panel 52 has a cutout 68 sized to expose the indicia 106 on the front side 102 of the gift card. These cutouts 66 and 68 may be die cut into the cardstock forming the package 50, or may be formed by other methods. A series of slits 70 may be cut into the back panel 54 and arranged with respect to one another for accepting corner regions 110 of the gift card 100 to secure the card 100 with the back panel 54 such that the card back side 104 faces the inner surface 62 of the back panel 54. These slits 70 are also disposed at a specific location, relative to the cutout 66, necessary to position the gift card 100 mounted onto the back panel 54 with the bar code 108 exposed through the cutout 66, as depicted in FIG. 10.

Alternatively, the slits 70 may be formed on the front panel 52 instead of the back panel 54 to properly position card 100 secured thereto for exposing the barcode 108 through the back panel cutout 66. In another variation, the back side 104 of the gift card 100 may be removably affixed (e.g., with adhesives) to the primary back panel 54 on the package inner surface 62 at a position to expose the bar code 108 through the back panel cutout 66. As seen in the partially opened/closed position of the package 50 in FIG. 9, which may also be referred to as the fully closed position if the cover panel 56 is not provided, the cutout 68 is formed on the front panel 52 at a specific location relative to the back panel cutout 66 and the slits 70 to expose the indicia 106 when the gift card 100 is mounted with the package 50. The cover panel 56 may also have a central cutout 72 to reveal certain graphics or wording present on the front panel 52 when the package 50 is in the closed position.

Figure 8:
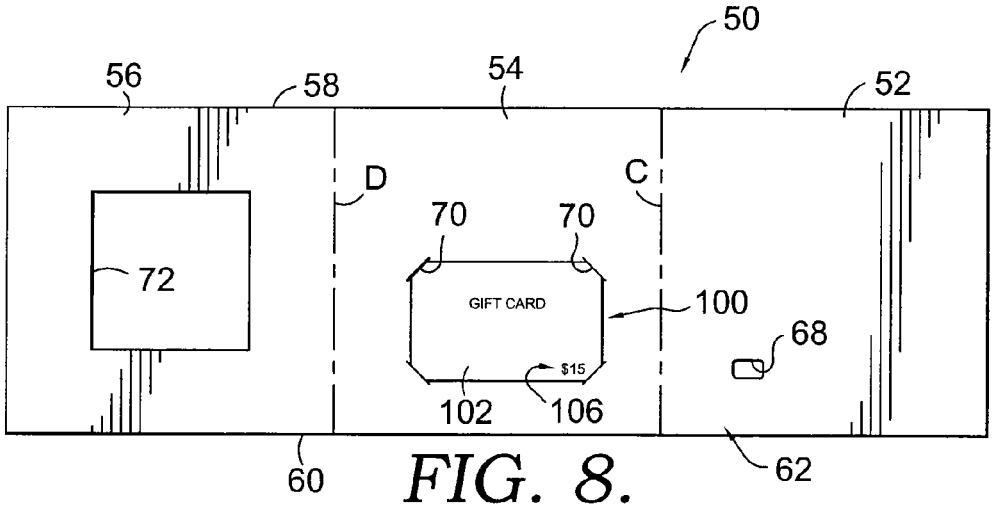
FIG. 8 is a front view of the gift card holding package of FIG. 7 in the fully opened position and with a gift card secured to the second panel.
Figure 9:
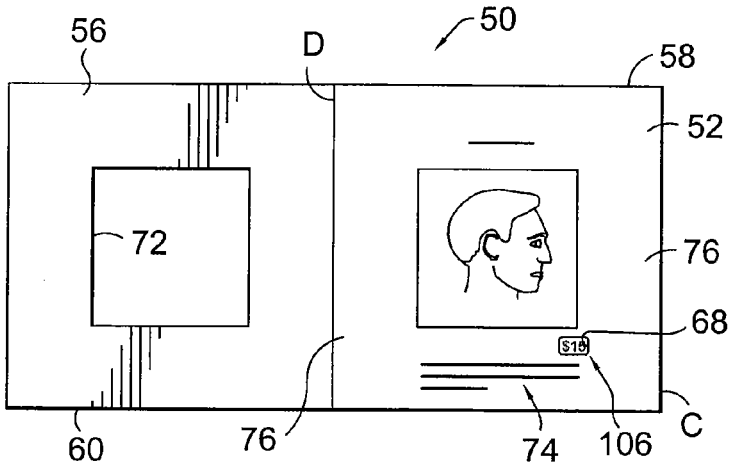
FIG. 9 is a front view of the gift card holding package of FIG. 8 in a partially opened position and with the gift card supported between the first panel and the second panel to expose indicia on a front surface of the gift card through a cutout in the first panel.

When the package 50 is presented to a recipient, the cover panel 56 may be unfolded along fold line D to fully reveal the message or sentiment 74 present on the front panel 52, as shown in FIG. 9. The cover panel 56 also conceals the indicia 106 exposed through the front panel cutout 68 so that the recipient first focuses on graphics or wording seen through the cover panel cutout 72 when the package 50 is first viewed in the closed position. Once the recipient has viewed the package 50 in the partially opened/closed position and sees that an item having purchasing credit is being received, the recipient can then unfold the front panel 52 along fold line C to reveal the gift card secured with the back panel 54, as shown in FIG. 8.

As with the embodiment of the package 10 depicted in FIGS. 1-6, the package 50 may be made of other materials besides cardstock, and the front panel 52 and back panel 54 may take the form of a pivotably connected members of a plastic case or the like for containing the gift card 100. Additionally, the front panel 52 may be fixedly positioned on the back panel 54 as a pocket for holding the gift card 100, with opposed side regions 76 of the front panel 52 being attached with the back panel 54 so that the front panel 52 does not unfold to the position shown in FIG. 8.

Therefore, various embodiments of the integrated gift card holder and message delivery package of the present invention provide a means for packaging a gift card for ease of scanning at a point-of-purchase location while focusing the recipient's attention on an accompanying message. Since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A greeting card for holding a gift card having a front side upon which indicia is located and an opposed back side upon which an identification marking is located, the greeting card comprising: a front panel having a cutout of a sufficient size for exposing the indicia on the front side of the gift card and at least one of a graphic and wording on a first surface of the front panel; a back panel connected with the front panel along a first common edge such that the front panel is pivotable with respect to the back panel and the front panel is juxtaposed the back panel, the back panel having a cutout of a sufficient size for exposing the identification marking on the back side of the gift card, wherein the front panel is movable to a first position where the front panel overlaps a portion of the back panel and wherein a gift card is positionable between the front and back panels when the front panel is in the first position, whereby the indicia on the front side of the gift card is viewable through the cutout in the front panel and the identification marking on the back side of the gift card is viewable through the cutout in the back panel; and a cover panel connected with the back panel along a second common edge such that the cover panel is pivotable with respect to the back panel and the cover panel is juxtaposed the back panel, wherein the cover panel is movable to a first position where the cover panel overlaps both the front panel when it is in its first position and the back panel, wherein the cover panel includes a cutout, and wherein the at least one of a graphic and wording on the first surface of the front panel is viewable through the cutout in the cover panel when the front panel is the first position and the cover panel is in the first position, wherein the cutout in the front panel is offset from the cutout in the cover panel when the front and cover panels are in their first positions such that the cutout in the front panel is not visible through the cutout in the cover panel and whereby the cover panel covers the cutout of the front panel.

2. The greeting card of claim 1, wherein the cutout in the front panel is smaller than the cutout in the back panel and wherein the cutout in the back panel is smaller than the cutout in the cover panel.

3. The greeting card of claim 1, wherein the back panel includes a plurality of slits surrounding the cutout in the back panel and wherein the slits are positioned to receive edges of the gift card for holding the gift card to the second panel in a position such that the identification mark is viewable through the cutout in the back panel.

4. A greeting card for holding a gift card having a front side upon which indicia is located and an opposed back side upon which an identification marking is located, the greeting card comprising:

a front panel having a cutout of a sufficient size for exposing the indicia on the front side of the gift card and at least one of a graphic and wording on a first surface of the front panel;

a back panel connected with the front panel along a first common edge such that the front panel is pivotable with respect to the back panel and the front panel is juxtaposed the back panel, the back panel having a cutout of a sufficient size for exposing the identification marking on the back side of the gift card, wherein the front panel is movable to a first position where the front panel overlaps a portion of the back panel and wherein a gift card is positionable between the front and back panels when the front panel is in the first position, whereby the indicia on the front side of the gift card is viewable through the cutout in the front panel and the identification marking on the back side of the gift card is viewable through the cutout in the back panel; and a cover panel connected with the back panel along a second common edge such that the cover panel is pivotable with respect to the back panel and the cover panel is juxtaposed the back panel, wherein the cover panel is movable to a first position where the cover panel overlaps both the front panel when it is in its first position and the back panel, wherein the cover panel includes a cutout, and wherein the at least one of a graphic and wording on the first surface of the front panel is viewable through the cutout in the cover panel when the front panel is the first position and the cover panel is in the first position;

wherein the cutout in the front panel is smaller than the cutout in the back panel and wherein the cutout in the back panel is smaller than the cutout in the cover panel;

wherein the cutout in the front panel is offset from the cutout in the cover panel when the front and cover panels are in their first positions such that the cutout in the front panel is not visible through the cutout in the cover panel and whereby the cover panel covers the cutout of the front panel;

wherein the back panel includes a plurality of slits surrounding the cutout in the back panel and wherein the slits are positioned to receive edges of the gift card for holding the gift card to the second panel in a position such that the identification mark is viewable through the cutout in the back panel;

wherein the front, back, and cover panels are formed from a single card blank; and wherein the front, back and cover panels are generally of a same size and shape.

5. The greeting card of claim 4, wherein the first common edge and the second common edge are parallel to each other and wherein the first common edge and the second common edge are on opposite sides of the back panel.

* * * * *